United States Patent [19]

Muehlberger et al.

[11] Patent Number: 4,877,640

[45] Date of Patent: Oct. 31, 1989

[54] METHOD OF OXIDE REMOVAL FROM METALLIC POWDER

[75] Inventors: Erich Muehlberger, San Clemente; Albert Sickinger, Irvine, both of Calif.

[73] Assignee: Electro-Plasma, Inc., Irvine, Calif.

[21] Appl. No.: 181,400

[22] Filed: Apr. 13, 1988

[51] Int. Cl.[4] ..... B05D 1/08

[52] U.S. Cl. ..... 427/34; 427/423; 75/10.19; 204/192.38

[58] Field of Search ..... 427/34, 423; 75/10.19; 204/192.38

[56] References Cited

U.S. PATENT DOCUMENTS

| | | | |
|---|---|---|---|
| 3,429,691 | 2/1969 | McLaughlin | 75/10.19 |
| 3,839,618 | 10/1974 | Muehlberger et al. | 219/121 P |
| 3,989,511 | 11/1976 | Fey et al. | 75/10.19 |
| 4,328,257 | 5/1982 | Muehlberger et al. | 427/34 |
| 4,784,159 | 11/1988 | Szilagyi | 427/34 X |

*Primary Examiner*—Shrive Beck

*Attorney, Agent, or Firm*—Scherlacher, Mok & Roth

[57] ABSTRACT

Metal particles in powdered form are cleaned of oxides by a method in which the particles are introduced into a plasma stream in the presence of a continuous negative transfer arc. Ionization of a gas within a plasma gun produces a plasma stream into which the metal particles are introduced at a location within the plasma gun. A negative transfer arc power source is continuously coupled between the plasma gun and a cathode downstream of the plasma gun and within the plasma stream to remove oxide coatings from the metal particles as they travel along the plasma stream to either a receptacle located downstream from the cathode or to a substrate which forms the cathode and onto which a relatively oxide-free coating is formed by the metal particles. Such methods of oxide removal are particularly effective with highly oxidizable refractory materials such as titanium, tantalum and aluminum.

12 Claims, 6 Drawing Sheets

METHOD OF OXIDE REMOVAL FROM METALLIC POWDER

BACKGROUND OF THE INVENTION

1. Field of the Invention

The present invention relates to plasma systems in which metal particles are sprayed by a plasma stream, and more particularly to a method of removing oxides from metallic powder particles introduced into a plasma stream.

2. History of the Prior Art

Refractory materials such as titanium and tantalum and even aluminum are difficult to produce in powdered form without an oxide layer being present on the surface of the powder particles. A typical process of forming the powder involves melting the metal and then introducing the molten metal into a gas stream. As the powder particles are formed, the highly oxidizable nature of the material causes an oxide layer to form on the outside of the particles. Such oxidation can be minimized by using other processes to form the powder, but such processes tend to be relatively expensive.

A further problem arises when metallic powders, particularly those of a highly oxidizable nature, are to be coated on a substrate using a plasma stream. Even where the powder is produced in a relatively oxide-free form, the mere process of introducing the powder into a plasma stream for coating on the substrate typically results in some oxidation of the powder particles. This is particularly true of highly oxidizable materials such as titanium, tantalum and aluminum. Workers skilled in the art have observed the tendency of most metallic particles to undergo some oxidation as they are sprayed in a plasma stream. A natural reaction to this has been a desire to spray the powdered materials quickly so that they are deposited on the substrate before substantial oxidation occurs. However, the speed of the oxidation process has been difficult to determine. Moreover, even where supersonic speeds of the plasma steam are produced such as through the use of a vacuum source to provide low static pressure, some oxidation of the metallic particles is still observed.

An example of a conventional supersonic plasma system is provided by U.S. Pat. No. 4,328,257 of Muehlberger et al. which issued May 4, 1982 and which is commonly assigned with the present application. The Muehlberger et al. patent describes a plasma system in which a vacuum source creates a low static pressure within an enclosure containing a plasma gun and a workpiece located downstream of the plasma gun. The plasma gun ionizes an inert gas to produce a plasma stream. The plasma stream flows from the plasma gun to the workpiece at supersonic speeds in the presence of the low static pressure provided by the vacuum source. Metallic powder introduced into the plasma stream at a location adjacent the plasma gun is carried to the workpiece where it is deposited on the workpiece as a coating.

The plasma system described in the Muehlberger et al. patent employs switchable transfer arc power supplies which are advantageously employed to initially establish a negative or cathodic condition at the workpiece for purposes of cleaning the workpiece. Thereafter, the workpiece is made positive relative to the plasma gun to enhance the depositing of the metallic powders introduced into the plasma stream onto the workpiece. In spite of the supersonic speeds of the plasma stream, it has been observed that some oxidation of the metallic powder still occurs as it travels along the plasma stream. This is especially true in the case of the highly oxidizable refractory materials, even when such materials are introduced into the plasma stream in a relatively pure, oxide-free form. As previously noted such materials are difficult to produce in powdered form without the formation of an oxide coating on the particles, with the result that the less expensive processes for producing the metallic powders provide the powder particles with an oxide coating before they are even introduced into the plasma stream. All of this results in the presence of substantial oxides in the coating formed on the workpiece.

An alternative approach to the spraying of metallic powders in a plasma stream which minimizes oxides is described in U.S. Pat. No. 4,689,468 of Muehlberger which issued Aug. 25, 1987, and which is commonly assigned with the present application. In the '468 patent of Muehlberger, a main plasma gun and a second or clean-up plasma gun simultaneously provide transfer arcs of opposite polarities at a common workpiece or substrate, with the result that oxides at the workpiece or substrate are significantly reduced. However, such oxide reduction comes at the expense of a more elaborate system requiring the presence of the second plasma gun and a separate set of power supplies therefor.

Accordingly, it would be advantageous to provide a process for removing the oxide coatings from highly oxidizable metal particles using a single plasma gun. It would furthermore be advantageous to provide a process for removing the oxide coatings from metal particles in conjunction with the spraying of such particles onto a workpiece or substrate.

BRIEF SUMMARY OF THE INVENTION

Oxide coatings are removed from metal particles in powdered form utilizing methods in accordance with the invention in which the particles are introduced into a plasma stream in the presence of a continuous negative transfer arc. The plasma stream is produced by ionizing an inert gas within a plasma gun. The plasma stream is preferably provided with supersonic speed through the use of a vacuum source to provide a low static pressure, although pressures as high as atmospheric pressure can be used. The continuous negative transfer arc is produced by continuously coupling a negative transfer arc power source between the plasma gun and a cathode located downstream from the plasma gun.

The continuous presence of the negative transfer arc along a portion of the plasma stream between the plasma gun and the cathode produces an electron emission from the cathode. The electron emission produces an electromagnetic propagation of electron current. The electromagnetic propagation has been found to remove substantial portions of oxide coatings already formed on metallic particles traveling in the plasma stream between the plasma gun and the cathode, and to prevent such oxide layers from forming in instances where the metallic particles are introduced into the plasma stream in a relatively pure, oxide-free form. A continuous cleaning, oxide-removing process takes place at the cathode, which acts to continuously clean the metallic coating formed therein where the cathode comprises a substrate.

In accordance with the invention, the continuous negative transfer arc can be employed to simply clean the metal particles by removing the oxide coatings therefrom, in which event the cleaned metal particles in the plasma stream are collected in a receptacle located downstream from the cathode. In such instances, the cathode may comprise a hollow, generally ring-shaped electrode disposed within the plasma stream so that the plasma stream flows through the hollow interior thereof.

Further in accordance with the invention, the continuous negative transfer arc can be used to remove the oxide coatings from the metal particles prior to the particles forming a coating on a substrate or other workpiece. This is accomplished by coupling the substrate as the cathode. Following removal of the oxide coatings, the cleaned particles arrive at the substrate where they form a relatively oxide-free coating on the substrate.

BRIEF DESCRIPTION OF THE DRAWINGS

A better understanding of the invention may be had by reference to the following specification in conjunction with the accompanying drawings, in which.

DETAILED DESCRIPTION OF THE INVENTION

Figure 1:
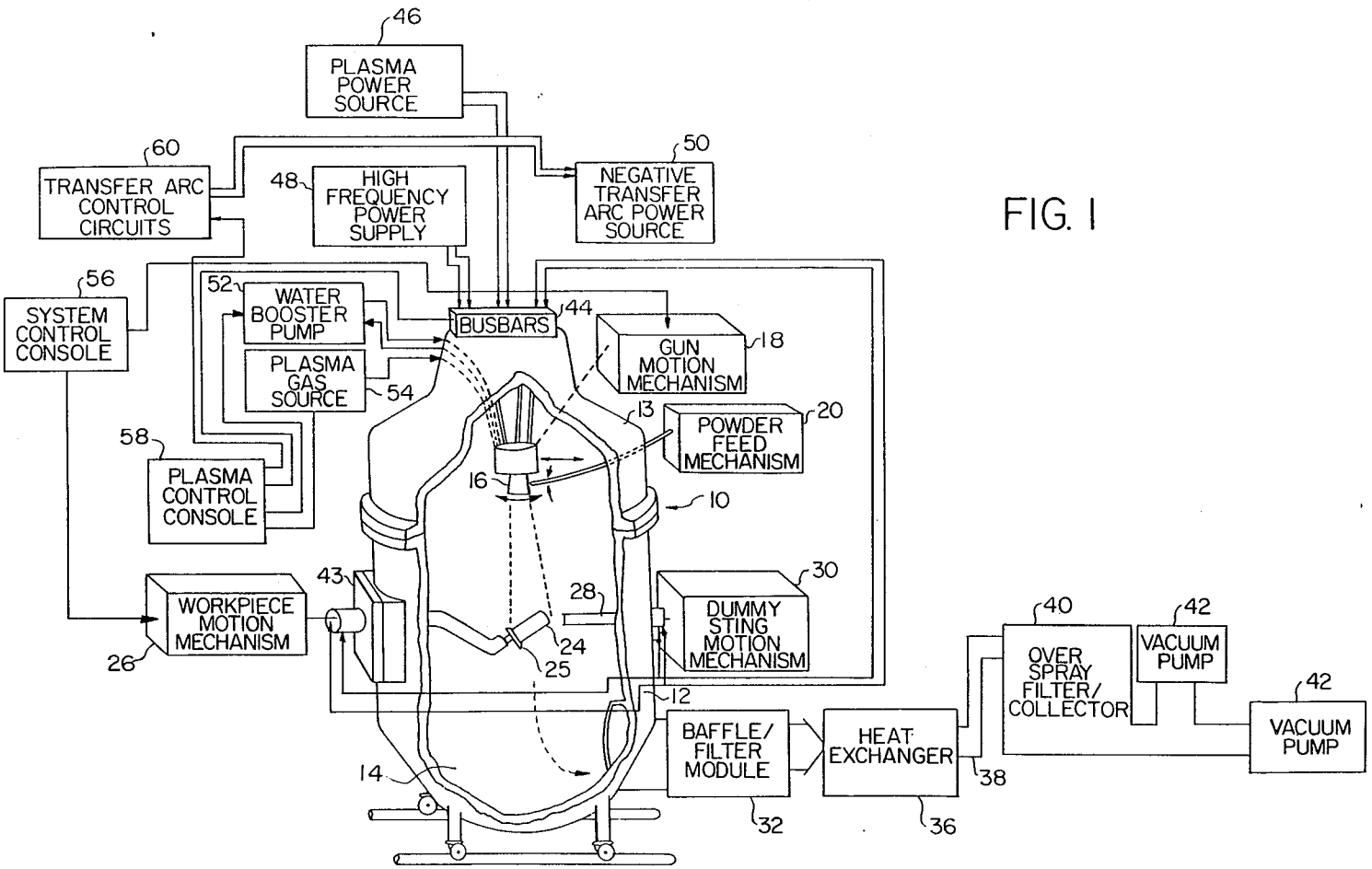
FIG. 1 is combined block diagram and perspective view, partially broken away, of a plasma system in which methods according to the invention can be carried out.

FIG. 1 depicts a plasma system for use in carrying out methods according to the invention. The plasma system of FIG. 1 includes a plasma chamber 10 that provides a sealed vacuum-maintaining and pressure-resistant insulative enclosure. The chamber 10 is defined by a cylindrical principal body portion 12, and an upper lid portion 13 joined thereto. The body portion 12 of the plasma chamber 10 includes a bottom collector cone 14 that leads into and communicates with associated units for processing the exiting gases and particulates in maintaining the desired ambient pressure.

A downwardly directed plasma stream is established by a plasma gun 16 mounted within the interior of the chamber lid 13, the position of which gun 16 is controlled by a plasma gun motion mechanism 18. Both parts of the plasma chamber 10 are advantageously constructed as double-walled, water-cooled enclosures and the lid 13 is removable for access to the operative parts. The gun motion mechanism 18 supports and controls the plasma gun 16 through sealed bearings and couplings in the walls of the chamber lid 13. A powder feed mechanism 20 also coupled to the chamber lid 13 provides controlled feed of a heated powder into the plasma stream through flexible tubes that are coupled to the plasma gun 16. The powder feed mechanism 20 is employed to introduce into the plasma stream metallic powder which is to be cleaned of oxide coatings thereon or which is to be maintained relatively oxide-free in accordance with the invention.

The downwardly directed plasma stream impinges on a workpiece 24 which is supported on an internally cooled conductive workpiece holder 25 and which is positioned and moved while in operation via a shaft extending through the chamber body 12 to an exterior workpiece motion mechanism 26. Adjacent one end of the workpiece 24, but spaced apart therefrom, is a dummy workpiece or dummy sting 28, which is similarly internally cooled and coupled through a sidewall of the chamber body 12 to a dummy sting motion mechanism 30. Both the workpiece holder 25 and dummy sting 28 are adjustable as to insert position with respect to the central axis of the chamber 10 and electrically conductive so that they may be held at selected potential levels for transfer arc generation during various phases of operation.

Below the workpiece 24 and the dummy sting 28 positions, the collector cone 14 directs the overspray gaseous and particulate materials into a baffle/filter module 32 having a water-cooled baffle section thereof for initially coupling the overspray and an in-line filter section thereof for extracting the majority of the entrained particle matter. Effluent passing through the baffle/filter module 32 is then directed through a heat-exchanger module 36, which may be another water-cooled unit, into a vacuum manifold 38 containing an overspray filter/collector unit 40 which extracts substantially all particulate remaining in the flow. The vacuum manifold 38 communicates with vacuum pumps 42 having sufficient capacity to maintain a desired ambient pressure within the chamber 10. This ambient pressure which is typically in the range from 0.6 atmospheres down to 0.001 atmospheres produces a static pressure sufficient to provide the plasma stream with supersonic speed.

The baffle/filter module 32 and the heat-exchanger module 36, as well as the overspray filter/collector 40 are preferably double-walled water-cooled systems, and any of the types well known and widely used in plasma systems may be employed. The entire system may be mounted on rollers and movable along rails for ease of handling and servicing of different parts of the system. Conventional viewing windows, water-cooled access doors and insulated feedthrough plates for electrical connection have not been shown or discussed in detail, for simplicity of illustration. The workpiece support and motion control system is advantageously mounted in a hinged front access door 43 in the chamber body 12.

Electrical energy is supplied into the operative portions of the system via fixed bus bars 44 mounted on the top of the chamber lid 13. Flexible water-cooled cables couple a plasma power source 46, a high frequency power supply 48 and a negative transfer arc power source via the bus bars 44 into the plasma gun 16 for generation of the plasma stream. The plasma power source 46 provides the requisite electrical potential difference between the electrodes of the plasma gun 16. The high frequency power supply 48 is used to initiate an arc within the plasma gun 16 by superimposing a high frequency voltage discharge on the D.C. power supply comprising the plasma power source 46. Thereafter, the negative transfer arc power source which is coupled between the plasma gun 16 and the workpiece 24 provides a continuous negative transfer arc therebetween in accordance with the invention.

Operation of the plasma gun 16 entails usage of a water booster pump 52 to provide an adequate flow of cooling water through the interior of the plasma gun 16. A plasma gas source 54 provides a suitable ionizing gas for generation of the plasma stream. The plasma gas here employed is either argon along or argon seeded with helium or hydrogen, although other gases may be employed as is well known to those skilled in the art.

Control of the sequencing of the system of FIG. 1 and the velocity and amplitude of motion of the various motion mechanisms is governed by a system control console 56. The plasma gun 16 is separately operated under control of a plasma control console 58. Inasmuch as the functions performed by these consoles and the circuits included therein are well understood, they have not been shown or described in detail. Transfer arc control circuits 60 may be used to control the negative transfer arc power source 50.

Most of what has been shown and described in connection with FIG. 1 is similar to the plasma system described in previously referred to U.S. Pat. No. 4,328,257 of Muehlberger et al., and reference thereto is made to the extent that further explanation of one or more portions of the plasma system may be needed.

Figure 2:
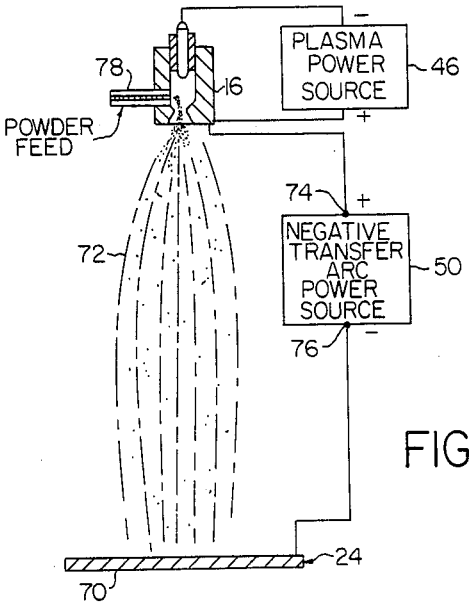
FIG. 2 is an idealized and simplified schematic view of a portion of a plasma spray system in accordance with the invention in which metallic particles are cleaned of oxide coatings before forming a coating on a substrate.

FIG. 2 is an idealized and simplified schematic view of a portion of the plasma system of FIG. 1 in which the workpiece 24 comprises a substrate 70. As such, FIG. 2 depicts a plasma system for spraying metallic powder to form a coating on the substrate 70. The plasma gun 16 ionizes inert gas in the manner previously described to provide a plasma stream which extends between the plasma gun 16 and the substrate 70. The plasma stream is represented by a series of dashed lines 72.

The negative transfer arc power source 50 is continuously coupled between the plasma gun 16 and the substrate 70. The negative transfer arc power source 50 has a positive terminal 74 which is coupled to the plasma gun 16. The negative transfer arc power source 50 has a negative terminal 76 which is coupled to the substrate 70. This causes the substrate 70 to act as a cathode. Accordingly, the negative transfer arc power supply 50 provides a continuous negative transfer arc in conjunction with the plasma stream 72 along a portion of the plasma stream 72 between the plasma gun 16 and the substrate 70. Metallic powder to be coated on the substrate 70 is provided by the powder feed mechanism 20 previously described in connection with FIG. 1. The powder feed mechanism 20 which is not shown in FIG. 2 includes a powder delivery tube 78 which terminates within the plasma gun 16 where the metallic powder is fed into the plasma stream 72.

In accordance with the invention, the substrate 70 which functions as a cathode relative to the plasma gun 16 by virtue of the negative transfer arc power source 50 emits electrons therefrom. This results in a electromagnetic propagation of electron current between the substrate 70 and the plasma gun 16. As the metallic particles of the powder travel in the plasma stream from the plasma gun 16 to the substrate 70, the flow of negative electrons from the substrate 70 encounters the particles and removes all or at least a substantial portion of any oxide coatings present on the particles. When the particles reach the substrate 70 to form a coating thereon, the particles are substantially free of oxides. In addition, a continuous cleaning action is provided at the coating on the substrate 70, by virtue of which any oxides present at the coating continue to be removed therefrom.

The removal of oxide coatings has been found to be particularly advantageous in the case of highly oxidizable refractory metals such as titanium, tantalum and even aluminum. Where particles of such metals are introduced into the plasma stream 72, the oxide coatings which are typically already present on such particles as a result of the powder forming process are removed from the particles as they travel to the substrate 70, resulting in a metallic coating on the substrate 70 which has a very low oxide content therein. Metallic particles introduced into the plasma stream 72 in a relatively pure, oxide-free form tend to remain so as they travel along the plasma stream 72 to the substrate 70. Thus, methods in accordance with the invention are advantageously used with metallic particles of all types including those which are highly oxidizable and those which oxidize at considerably lower rates.

The oxide reduction produced by the use of a continuous negative transfer arc in accordance with the invention can be better appreciated by referring to the photomicrographs of FIGS. 4–7.

Figure 4:
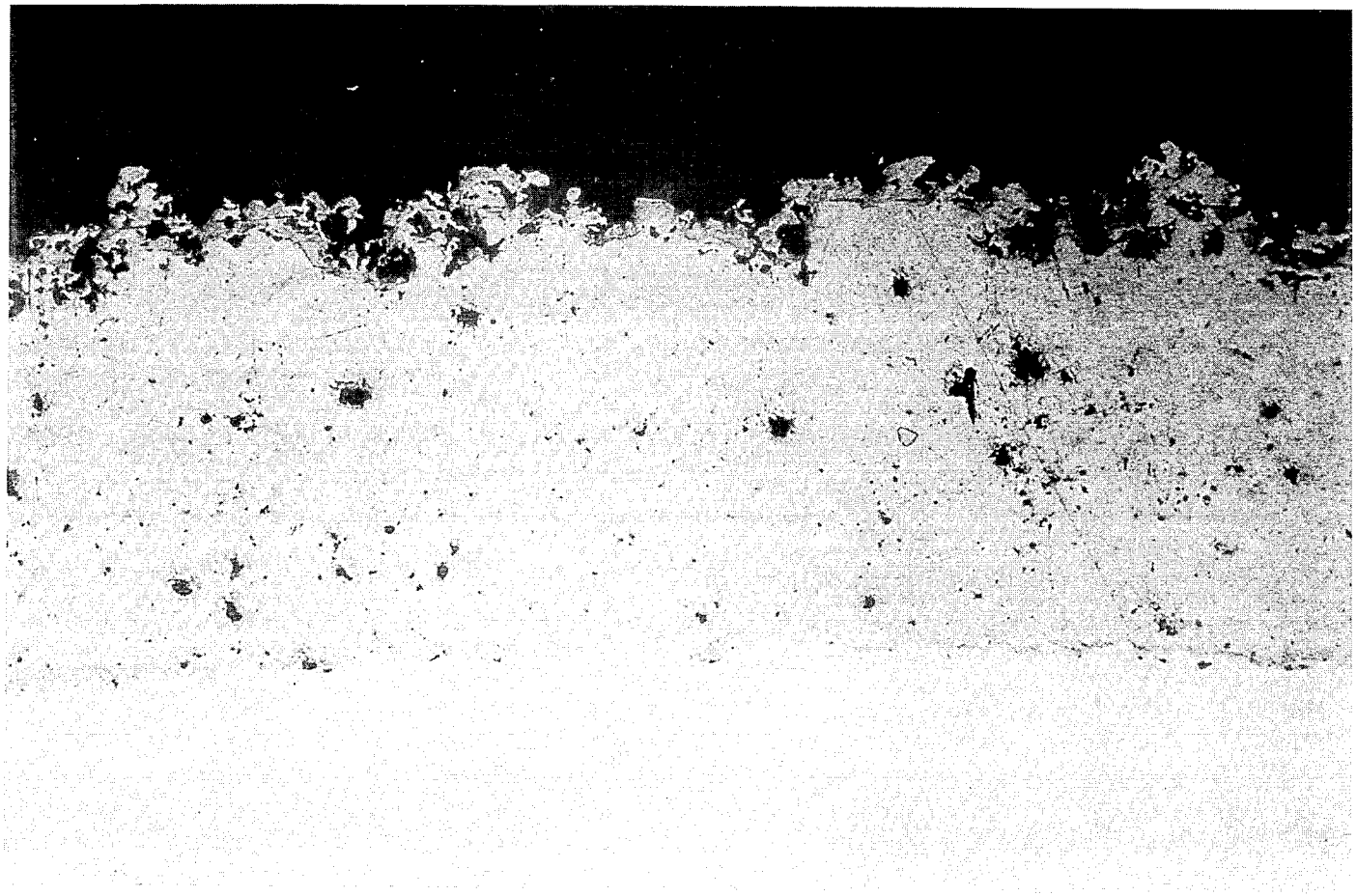
FIG. 4 is a photomicrograph, magnified 100 times, of a titanium coating formed on a substrate using a conventional process of the prior art.

FIG. 4 is a photomicrograph, magnified 100 times, of a coating of titanium on a substrate such as the substrate 70 of FIG. 2. The titanium coating was placed on the substrate without using a negative transfer arc. It will be observed that the titanium coating has numerous dark spots therein, many of which are relatively large. The dark spots are voids and oxides in the coating. The coating in the example of FIG. 4 is regarded as being somewhat porous and having a rather high oxide content which is undesirable.

Figure 5:
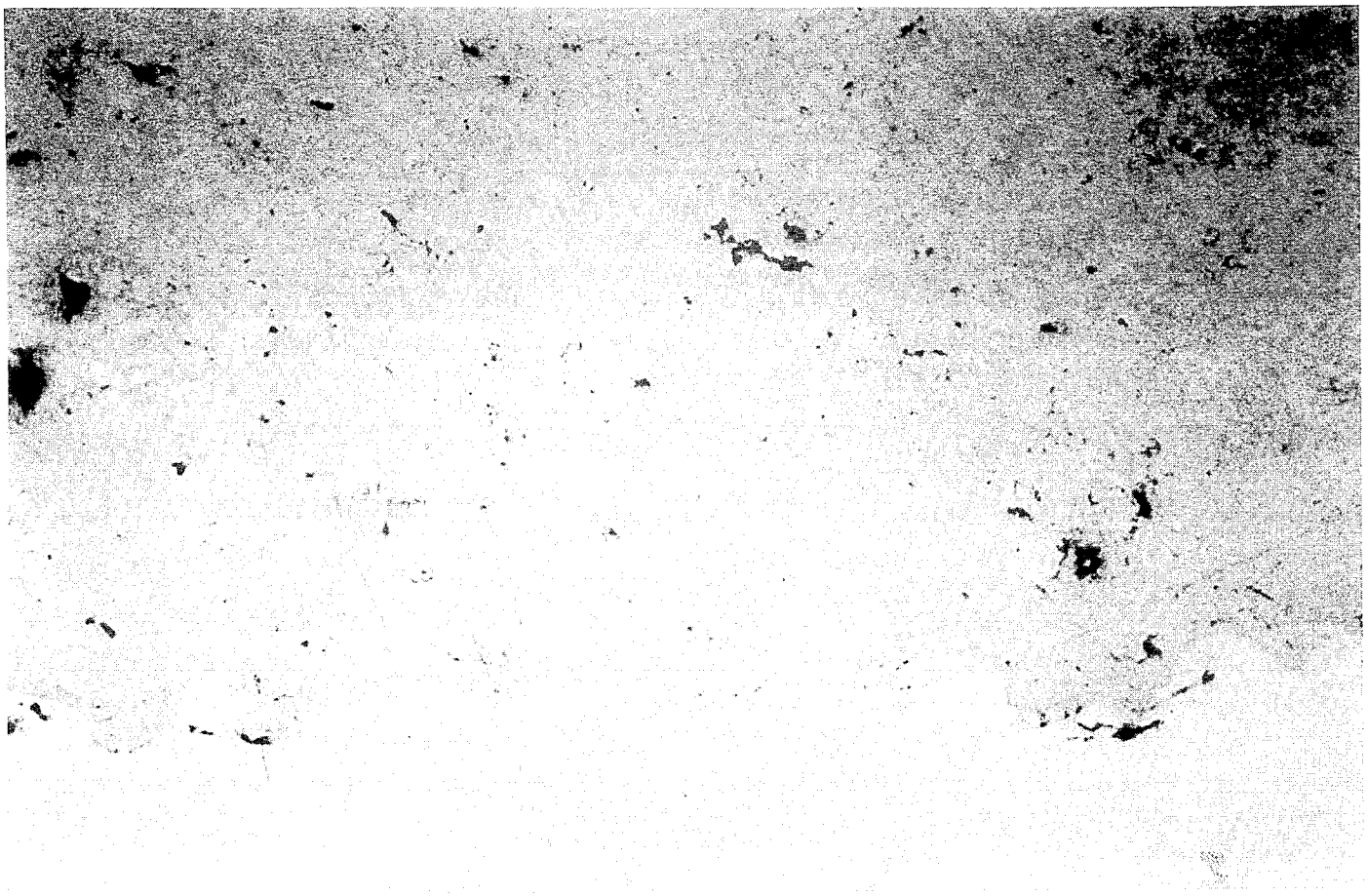
FIG. 5 is a photomicrograph, magnified 400 times, of a portion of the titanium coating and the substrate shown in FIG. 4.

FIG. 5 which is a photomicrograph, magnified 400 times, of a portion of the titanium coating and the substrate of FIG. 4 illustrates in even greater detail the significant voids and the substantial amount of oxides present in the titanium coating.

Figure 6:
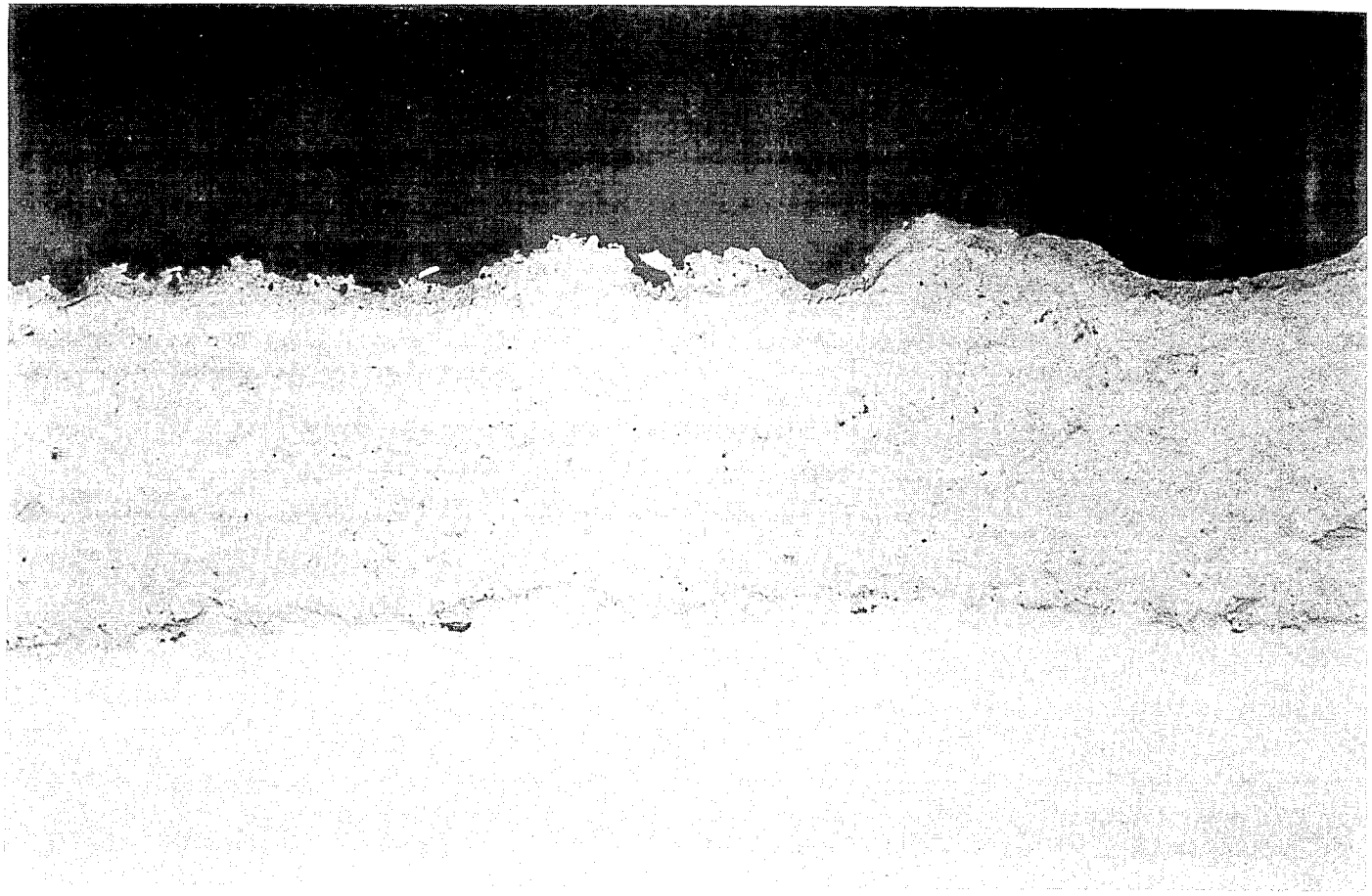
FIG. 6 is a photomicrograph, magnified 100 times, of a titanium coating formed on a substrate using a process in accordance with the invention.

FIG. 6 is a photomicrograph, magnified 100 times, of a titanium coating on a substrate. The titanium coating illustrated in FIG. 6 was applied using a continuous negative transfer arc in the manner described in connection with FIG. 2. It will be observed that when compared with FIG. 4 the titanium coating of FIG. 6 has a substantially lower void and oxide content. The dark spots which represent voids and oxides are considerable fewer and smaller in size in FIG. 6.

Figure 7:
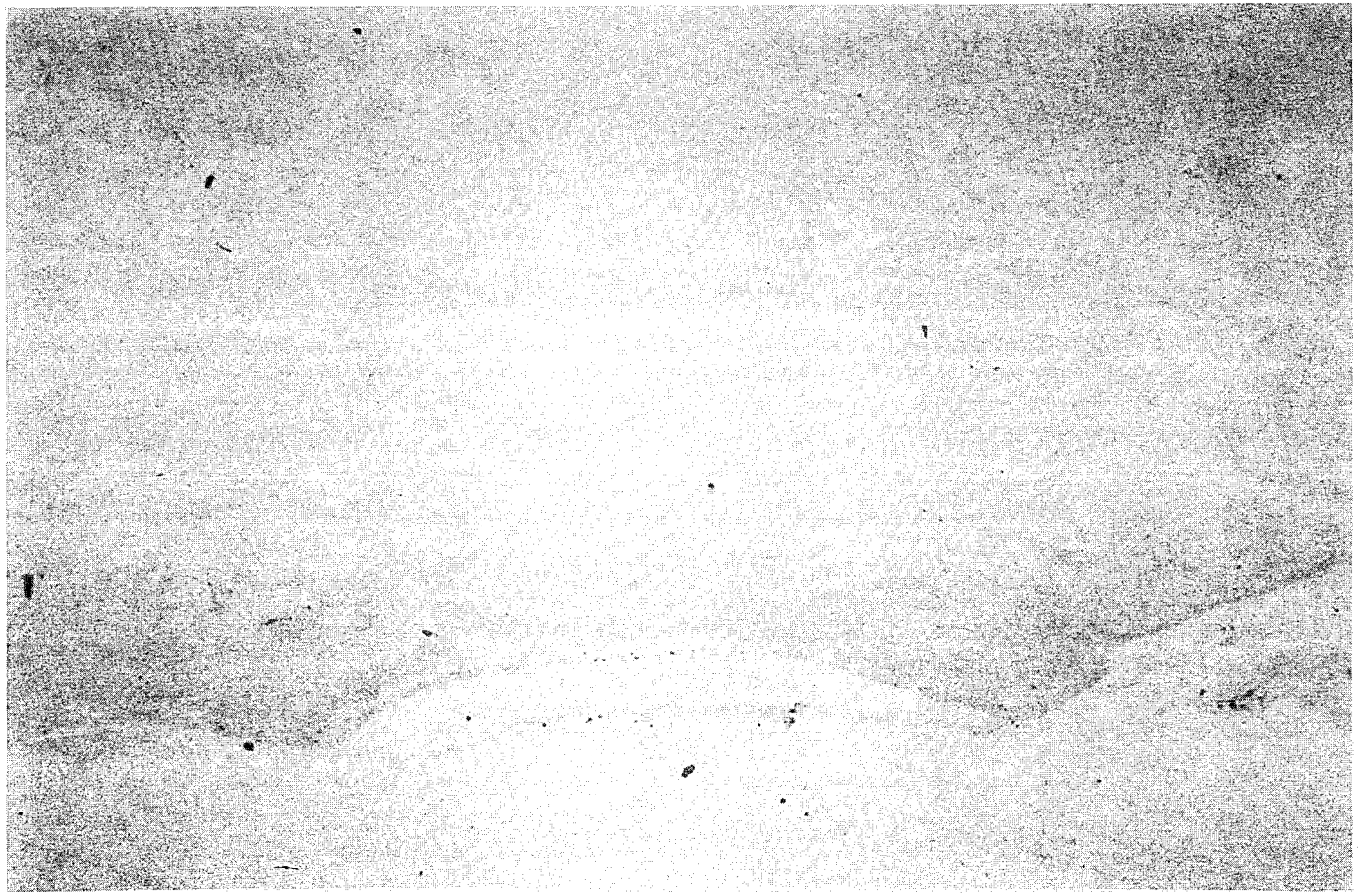
FIG. 7 is a photomicrograph, magnified 400 times, of a portion of the titanium coating and the substrate shown in FIG. 6.

FIG. 7 is a photomicrograph, magnified 400 times, of a portion of the titanium coating and the substrate of FIG. 6. FIG. 7 illustrates in greater detail the low void and oxide content of the titanium coating applied in accordance with the invention, particularly when contrasted with the photomicrograph of similar magnification provided by FIG. 5.

Referring again to FIG. 2, it will be understood that processes in accordance with the invention include the generation of a plasma stream such as the plasma stream 72 utilizing the plasma gun 16. The negative transfer arc power source 50 or other appropriate means is employed to continuously maintain a negative transfer arc in conjunction with the plasma stream 72 along a portion of the plasma stream 72. In the example of FIG. 2 the negative transfer arc is maintained in conjunction with the plasma stream 72 along the entire length of the plasma stream 72 between the plasma gun 16 and the substrate 70. Prior to the introduction of the powdered metal into the plasma stream 72, the plasma stream 72 may be employed in conjunction with the negative transfer arc to clean the surface of the substrate 70 where desired. As the particles of the powdered metal are introduced into the plasma stream 72 within the plasma gun 16, the metal particles are entrained into and flow with the plasma stream 72 to the substrate 70, and in the process are cleansed of any oxide coatings thereon in the manner previously described. The metal particles are received by the substrate 70 where they form a coating thereon.

The plasma stream 72 is preferably provided with a supersonic speed. This is accomplished in the manner previously described in connection with FIG. 1 by use of the downstream vacuum pumps 42 to provide a relatively low static pressure in the region of the plasma gun 16 and the workpiece 24 or the substrate 70 within the plasma chamber 10. However, it should be understood that methods in accordance with the invention can be used with higher static pressures as well, including even atmospheric pressure.

In the example of FIG. 2, the metallic particles are coated on the surface of the substrate 70 in relatively oxide-free form, as well as being cleaned of oxide coatings in those instances where the particles are provided to the plasma stream 72 in an impure, oxide-coated form. It may be desirable in certain instances to clean the metallic particles by removing the oxide coatings therefrom without spraying the particles as a coating on a substrate. Such an arrangement for cleaning the metallic particles is shown in an idealized and simplified schematic form in FIG. 3.

Figure 3:
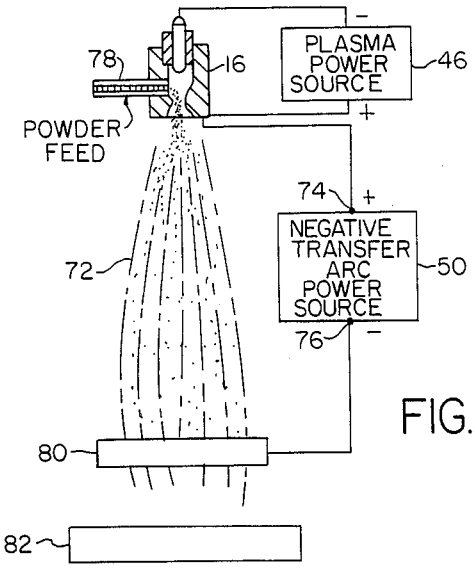
FIG. 3 is an idealized and simplified schematic view of a portion of a plasma spray system in accordance with the invention in which metallic particles are cleaned of oxide coatings and then collected in powdered form.

The arrangement of FIG. 3 is like that of FIG. 2, except that the cathode in the FIG. 3 arrangement is provided by a hollow, generally ring-shaped electrode 80. The electrode 80 which is coupled to the negative terminal 76 of the negative transfer arc power source 50 is disposed within the path of the plasma stream 72 so that the plasma stream 72 passes through the hollow interior thereof. The negative transfer arc power source 50 maintains a negative transfer arc along a portion of the plasma stream 72 extending from the plasma gun 16 to the electrode 80. The electrode 80 emits electrodes in the same manner as the substrate 70 in the arrangement of FIG. 2 to provide an electromagnetic propagation of electron current which removes oxide coatings from the metallic particles as the particles are conveyed by the plasma stream 72 from the plasma gun 16 to the electrode 80. The cleaned metallic particles are then collected by a receptacle 82 disposed within the path of the plasma stream 72 downstream of the electrode 80. The metallic powder which is introduced into the plasma stream 72 within the plasma gun 16 is thus cleansed of any oxide coatings thereon and then collected in a relatively pure form in the receptacle 82.

While various forms and modifications have been suggested, it will be appreciated that the invention is not limited thereto but encompasses all expedients and variations falling within the scope of the appended claims.

What is claimed is:

1. A method of cleansing metal particles of oxides comprising the steps of:

generating a plasma stream;

locating a cathode within the plasma stream;

continuously maintaining a negative transfer arc in conjunction with the plasma stream along a portion of the plasma stream extending to the cathode;

introducing metal particles into the plasma stream; and receiving the metal particles after they have traveled along said portion of the plasma stream.

2. The invention set forth in claim 1, wherein the step of receiving the metal particles comprises placing a substrate at an end of said portion of the plasma stream so that the metal particles form a coating on the substrate.

3. The invention set forth in claim 1, wherein the step of receiving the metal particles comprises placing a container downstream from said portion of the plasma stream to catch the metal particles in the plasma stream.

4. The invention set forth in claim 1, wherein the step of generating a plasma stream comprises operating a plasma gun in the presence of a source of reduced pressure to generate a supersonic plasma stream.

5. The invention set forth in claim 4, wherein the step of continuously maintaining a negative transfer arc comprises continuously coupling a negative transfer arc power source between the plasma gun and the cathode at an end of said portion opposite the plasma gun.

6. The invention set forth in claim 5, wherein the step of introducing metal particles comprises introducing metal particles into the plasma stream within the plasma gun.

7. A method of spraying metal particles onto a substrate in a manner which cleanses the metal particles of oxides comprising the steps of:

operating a plasma gun to direct a plasma stream onto the substrate;

introducing the metal particles into the plasma stream at a location adjacent the plasma gun; and continuously coupling a negative transfer arc power source between the plasma gun and the substrate to continuously provide a negative transfer arc between the plasma gun and the substrate, the substrate thereby functioning as a cathode to provide an electron emission therefrom which cleanses the metal particles of oxides.

8. The invention set forth in claim 7, wherein the step of introducing the highly oxidizable metal particles into the plasma stream comprises introducing powdered metal chosen from the group consisting of titanium, tantalum and aluminum.

9. The invention set forth in claim 7, wherein the step of operating a plasma gun comprises locating a vacuum source downstream of the substrate from the plasma gun to provide a low static pressure and ionizing a gas stream in the plasma gun to produce a plasma stream which travels to the substrate at supersonic speeds in the presence of the low static pressure.

10. A method of cleaning oxidized metal particles comprising the steps of:

providing a receptacle;

operating a plasma gun to direct a plasma stream into the receptacle;

introducing the oxidized metal particles into the plasma stream at a location adjacent the plasma gun;

locating an electrode within the plasma stream adjacent the receptacle; and continuously coupling a negative transfer arc power source between the plasma gun and the electrode to continuously provide a negative transfer arc between the plasma gun and the electrode, the electrode thereby functioning as a cathode to provide an electron emission therefrom which cleans the oxidized metal particles.

11. The invention set forth in claim 10, wherein the step of locating an electrode within the plasma stream comprises locating a ring-shaped electrode adjacent the receptacle so that the plasma stream may pass through a hollow interior of the ring-shaped electrode.

12. The invention set forth in claim 10, wherein the step of operating a plasma gun comprises ionizing a gas in the presence of low static pressure to produce a supersonic plasma stream.

* * * * *